US005679064A

United States Patent [19]

Nishi et al.

[11] Patent Number: 5,679,064

[45] Date of Patent: Oct. 21, 1997

[54] POLISHING APPARATUS INCLUDING DETACHABLE CLOTH CARTRIDGE

[75] Inventors: Toyomi Nishi, Yokohama; Tamami Takahashi, Yamato; Tetsuji Togawa, Fujisawa, all of Japan

[73] Assignee: Ebara Corporation, Tokyo, Japan

[21] Appl. No.: 561,024

[22] Filed: Nov. 21, 1995

[51] Int. Cl.[6] ..... B24B 7/04; B24B 29/02

[52] U.S. Cl. ..... 451/288; 451/286; 451/290; 451/488; 451/550

[58] Field of Search ..... 451/285–288, 451/290, 294, 158, 488, 548, 550, 53, 449

[56] References Cited

U.S. PATENT DOCUMENTS

| | | | |
|---|---|---|---|
| 3,753,322 | 8/1973 | Bordes | 451/42 |
| 3,777,443 | 12/1973 | Shaw | 451/488 |
| 3,932,966 | 1/1976 | Stern | 451/488 |
| 4,350,497 | 9/1982 | Ogman | 451/546 |
| 4,527,358 | 7/1985 | Day . | |
| 4,538,384 | 9/1985 | Huber et al. | 451/53 |
| 4,612,737 | 9/1986 | Adee et al. | 451/29 |
| 5,400,547 | 3/1995 | Tanaka et al. | 451/488 |
| 5,427,566 | 6/1995 | Landi et al. | 451/532 |

*Primary Examiner*—Timothy V. Eley
*Attorney, Agent, or Firm*—Wenderoth, Lind & Ponack

[57] ABSTRACT

A polishing apparatus includes a light weight and easily interchangeable cloth cartridge of high deformation resistance. The cloth cartridge is made by bonding a polishing cloth to a cartridge base member which includes a honeycomb structure member which can be sandwiched between top and bottom aluminum thin plates. Honeycomb structure member of various cell sizes and materials available in the marketplace can be used for this purpose quite effectively. The honeycomb structure members made of an aluminum material provides a stiff and thermally resistant cartridge base member. Cell spaces in the honeycomb structure member can be cooled or heated, depending on a nature of the polishing slurry used, by passing an appropriate fluid through the base member. This is made possible by providing flow holes in the cell walls separating the honeycomb cells. This approach is effective in producing optimum polishing performance by the cloth cartridge. Thermal control can be exercised generally or locally, depending on where heat is needed or should be removed.

19 Claims, 2 Drawing Sheets

POLISHING APPARATUS INCLUDING DETACHABLE CLOTH CARTRIDGE

BACKGROUND OF THE INVENTION

1. Field of the Invention

The present invention relates in general to an apparatus for polishing of materials, and relates in particular to a polishing apparatus for polishing an object such as a semiconductor wafer to a flat and mirror finish.

2. Description of the Related Art

High density integrated semiconductor devices of recent years require increasingly finer microcircuits, and the interline spacing has also shown a steady trend of decreasing dimensions. For optical lithography operations based on less than 0.5 micrometer interline spacing, the depth of focus is shallow and high precision in flatness is required on the polished object which has to be coincident with the focusing plane of the stepper.

This requirement means that the wafer surface must be made extremely flat, and one way to achieve such precision in flatness begins with proper surface preparation by polishing with a polishing apparatus.

The conventional type of polishing apparatus used in such applications comprises a turntable with a polishing cloth mounted on a top surface, and a top ring, each of which is provided with an independent rotational control, and an object to be polished is held between the top ring and the turntable. The surface of the object to be polished is pressed down onto the polishing cloth by the top ring exerting a controlled pressure while dripping a polishing solution on the polishing cloth. The process is continued until the polishing surface is polished to the required degree of flatness and mirror polish.

Changing of the polishing cloth on the turntable is performed by stopping the polishing apparatus, removing the polishing cloth from the turntable, washing off the residual polishing solution from the top surface of the turntable, drying the turntable and finally bonding a new polishing cloth directly on the turntable. This process is time consuming and creates a long downtime for the apparatus and leads to low productivity, i.e. a low number of polished objects produced per unit operation time of the apparatus.

A remedial approach to this productivity problem is to use a cartridge cloth system in which a polishing cloth is bonded to a base structure and this assembly is mounted on or removed from the turntable. The use of the cartridge cloth system eliminates the time required to change the cloth on the turntable, thereby leading to shortening of the downtime of the apparatus to improve the productivity of the polishing apparatus. This procedure is disclosed in a Japanese Patent Application, First Publication, H4-206929 and Japanese Patent Application, Second Publication, H2-30827.

To facilitate the exchange operation of the cartridge cloth system, it is better to have a light cartridge. Also the cartridge should be able to withstand loads applied during the polishing operation and show resistance to deformation from the effects of frictional heat generated by the object to be polished sliding on the polishing cloth. However, an ideal cartridge cloth system having the qualities of lightness and strength has not been made available to date.

Furthermore, sometimes it is desired to change the elastic nature of the cartridge structure (cloth and/or base member) depending on the nature of the polishing object, but there has not been any effective and practical method for satisfying this need.

SUMMARY OF THE INVENTION

An objective of a present invention is to provide a polishing apparatus having a cloth cartridge which is light weight and strong and which can be easily mounted on or demounted from the turntable.

This objective is achieved in a polishing apparatus for obtaining a flat and mirror polish on an object to be polished the apparatus including a turntable; a cloth cartridge detachably fixed to the turntable, and including a polishing cloth bonded to a top surface of a cartridge base member; pressing means for pressing down the object against the polishing cloth; and supply means for supplying a slurry on the polishing cloth; wherein the cartridge base member has a composite structure comprising a honeycomb structure member and thin plates. A honeycomb structure is structure comprising many cells of a polygonal cross section such as a hexagon, a pentagon, etc.

According to the polishing apparatus presented above, the cloth cartridge of the present invention offers light weight and strength because of its honeycomb structure member as well as providing the basic requirement of quick exchange capability.

The elastic properties of the cloth cartridge are easily modified by changing the cell size, the wall thickness and the material of the honeycomb structure according to each polishing task.

Further, the surface temperature of the polishing object during polishing can be controlled through the honeycomb structure member by providing flow openings in the cell walls and flowing a fluid medium through the honeycomb structure member to control the thermal conditions prevailing at the polishing surface. Thermal control can be localized by properly targeting the distribution of the holes.

DESCRIPTION OF THE PREFERRED EMBODIMENTS

A preferred embodiment of the present polishing apparatus will be explained with reference to the drawings.

Figure 1:
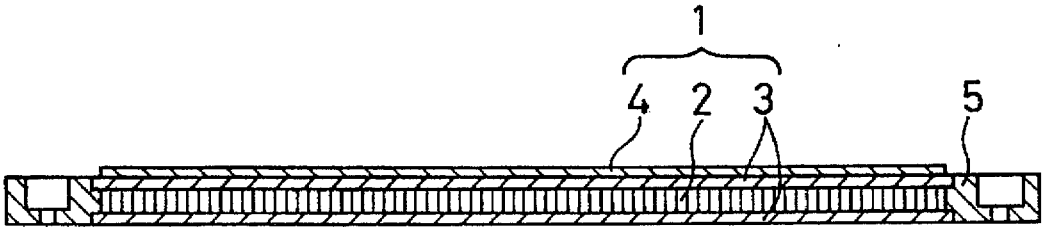
FIG. 1 is a cross sectional view of a portion of a polishing apparatus of the present invention.

FIG. 1 shows a cross sectional view of a cloth cartridge for use in the polishing apparatus of the present invention. A honeycomb structure member (shortened to honeycomb member hereinbelow) 2 is shaped as a disk and has a plurality of hexagonal shaped cells oriented vertically. A cartridge base member is made by placing two thin aluminum disk plates 3 on top and bottom surfaces of the honeycomb member 2. The cartridge base member having such a triple layer structure is secured by placing a clamp 5 on the outer periphery thereof. A cloth cartridge 1 is made by bonding a polishing cloth 4 to the top surface of the cartridge base member (constituted by the honeycomb member 2, the top and bottom disk plates 3).

The weight of a conventional cartridge made of a solid aluminum disk of 600 mm diameter D and 15 mm thickness t can be compared with the weight of a honeycombed cartridge member of the same dimensions D and t. The weight is 12 Kg for the conventional solid disk cartridge and 4 Kg for the honeycombed cartridge. The weight of the cloth cartridge of the present invention is therefore about ⅓ of that of the conventional cloth cartridge made of a solid disk.

Figure 2:
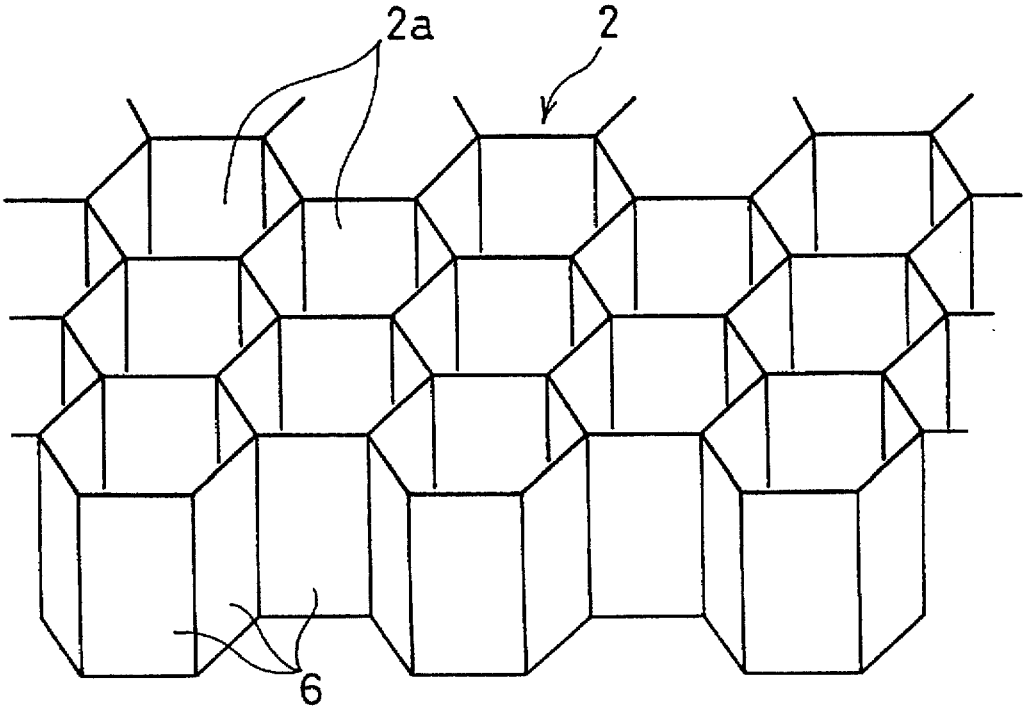
FIG. 2 is a perspective view of an example of a honeycomb structure included in the present polishing apparatus.

FIG. 2 is a perspective view of an example of the honeycomb member 2 for use with the cloth cartridge of the present polishing apparatus. The honeycomb member 2 comprises cell (partition) walls 6 made of aluminum to form hexagonal shaped hollow cells 2*a*. The main features of the honeycomb structure, i.e. that it is light weight and has a high, stiffness in one direction, are useful in applications such as aircraft wings. Also, such honeycomb structures of various cell sizes and different materials are commonly available in the marketplace. By choosing a suitable size of honeycomb and a material of construction, the elastic properties of the cloth cartridge 1 can be adjusted to suit the requirements of a particular application. This flexibility in selection of cloth cartridges enables one to choose a cloth cartridge for maximum performance for different polishing requirements of different polishing objects.

Figure 3:
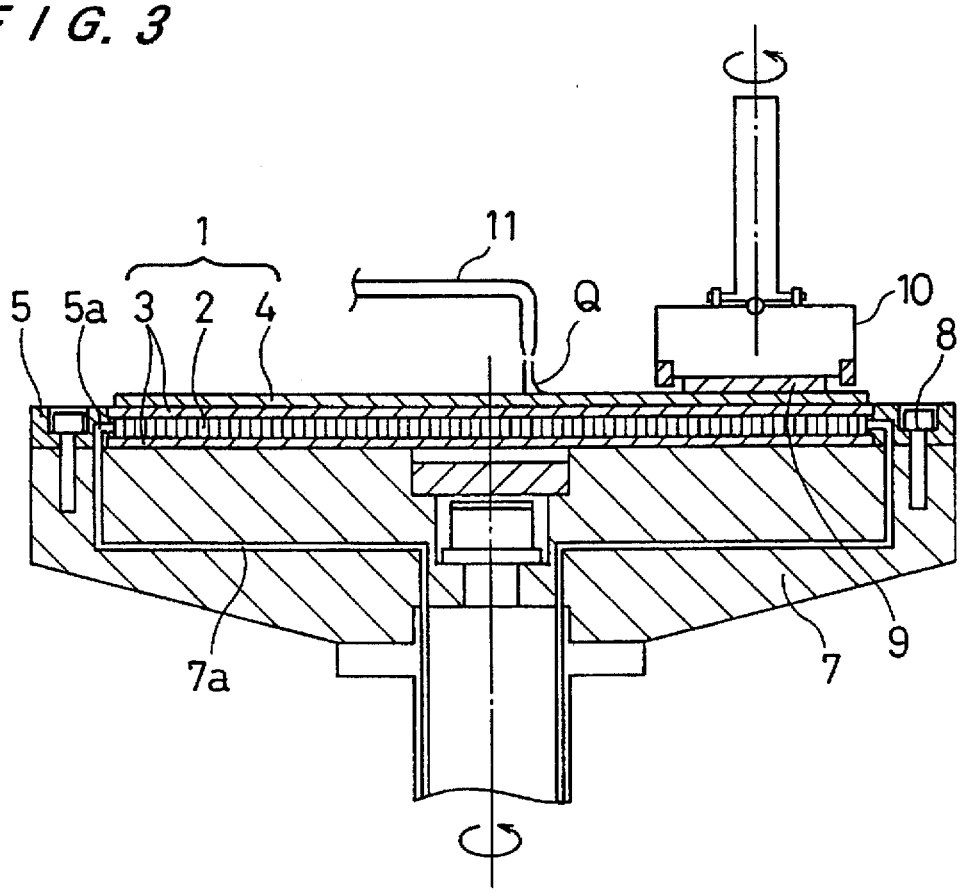
FIG. 3 is a vertical cross sectional view to show the arrangement of basic components of polishing apparatus of the present invention.

FIG. 3 is a schematic sectional view of the polishing section of the present polishing apparatus. A cloth cartridge 1 having a polishing cloth 4 bonded to a cartridge base member is detachably fixed to a top surface of a turntable 7 by means of bolts 8. A wafer 9 to be polished is mounted on the bottom section of a top ring 10, so that a surface to be polished faces the polishing cloth 4 and the wafer 9 is pressed down onto the polishing cloth 4. For polishing, the turntable 7 and the top ring 10 are usually operated to rotate in the same direction and at the same rotational speed. During polishing, a slurry Q containing an abrasive material is dripped onto the polishing cloth 4 through a slurry nozzle 11.

During the polishing process, to prevent the generation of thermal deformation of the cloth cartridge 1 caused by the frictional heat generated between the wafer 9 and the polishing cloth 4, the honeycomb member 2 can be cooled by introducing a cooling fluid medium such as water through flow passages 7*a*, 5*a* provided respectively on turntable 7 and the cloth cartridge 1.

Figure 4:
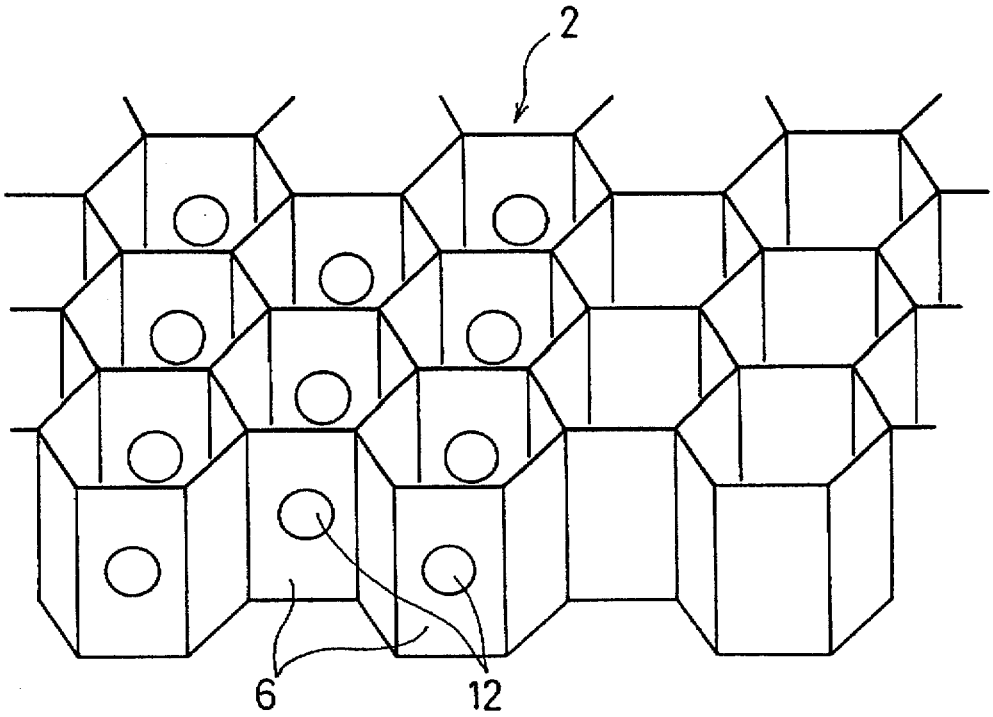
FIG. 4 is a perspective view of a honeycomb structure having flow passages for thermal control of a polishing interface.

FIG. 4 is a perspective view to show an example of flow openings 12 provided in cell walls 6 of the honeycomb member 2. The flow openings 12 are formed in the cell walls 6 of the honeycomb member 2, and the cooling medium flows through the flow openings 12 to cool the interior spaces or cells of the honeycomb member 2. By limiting the flow openings to particular sites of active polishing, effective local cooling can be achieved. Various experiments were conducted to study the effects of cooling, and it was found that, depending on the type of slurry used, it is sometimes preferable to warm the polishing solution. This can be achieved by flowing a heated fluid medium to provide a suitable degree of heat to the polishing area of the honeycomb structure.

What is claimed is:

1. A cloth cartridge to be detachably exchangeably mounted on a turntable of a polishing apparatus for use in polishing an object to a flat and mirror polish, said cloth cartridge comprising:

a cartridge base member having a composite structure formed of a honeycomb structure member and thin plates; and a polishing cloth bonded to a surface of said cartridge base member that is to be directed upwardly when said cloth cartridge is mounted on a turntable.

2. A cloth cartridge as claimed in claim 1, wherein said honeycomb structure member is sandwiched between said thin plates.

3. A cloth cartridge as claimed in claim 2, wherein one of said thin plates defines said upper surface.

4. A cloth cartridge as claimed in claim 2, wherein said honeycomb structure member has internal cells extending upwardly between said thin plates.

5. A cloth cartridge as claimed in claim 1, wherein said honeycomb structure member comprises cell walls defining cells, at least some of said cell walls having therein flow openings connecting adjacent said cells.

6. A cloth cartridge as claimed in claim 5, wherein said flow openings connect only a portion of said cells.

7. A cloth cartridge as claimed in claim 1, wherein said honeycomb structure member has therein cells of polygon cross section.

8. A cloth cartridge as claimed in claim 7, wherein said cells are of a hexagonal polygonal cross section.

9. A polishing apparatus for obtaining a flat and mirror polish on an object to be polished, said apparatus comprising:

a turntable;

a cloth cartridge detachably exchangeably mounted on said turntable, said cloth cartridge including a cartridge base member and a polishing cloth bonded to an upper surface of said cartridge base member, said cartridge base member having a composite structure formed of a honeycomb structure member and thin plates;

a pressing device operable to press an object to be polished downwardly against said polishing cloth; and a supply operable to supply a slurry onto said polishing cloth.

10. A polishing apparatus as claimed in claim 9, wherein said honeycomb structure member is sandwiched between said thin plates.

11. A polishing apparatus as claimed in claim 10, wherein one of said thin plates defines said upper surface.

12. A polishing apparatus as claimed in claim 10, wherein said honeycomb structure member has internal cells extending upwardly between said thin plates.

13. A polishing apparatus as claimed in claim 9, wherein said honeycomb structure member comprises cell walls defining cells, at least some of said cell walls having therein flow openings connecting adjacent said cells, and further comprising means for supplying a temperature control fluid medium to said cloth cartridge so that such medium flows through said flow openings and said cells connected thereby.

14. A polishing, apparatus as claimed in claim 13, wherein said supplying means comprises flow passages provided in said turntable and said cloth cartridge.

15. A polishing apparatus as claimed in claim 13, wherein said supplying means comprises means to supply a cooling fluid as the fluid medium.

16. A polishing apparatus as claimed in claim 13, wherein said supplying means comprises means to supply a heating fluid as the fluid medium.

17. A polishing apparatus as claimed in claim 13, wherein said flow openings connect only a portion of said cells, thereby enabling localized thermal control within said cloth cartridge.

18. A polishing apparatus as claimed in claim 9, wherein said honeycomb structure member has therein cells of polygonal cross section.

19. A polishing apparatus as claimed in claim 18, wherein said cells are of a hexagonal polygonal cross section.

* * * * *